US010071467B2

(12) United States Patent
Roehm et al.

(10) Patent No.: US 10,071,467 B2
(45) Date of Patent: Sep. 11, 2018

(54) HANDHELD POWER TOOL

(75) Inventors: Heiko Roehm, Stuttgart (DE); Tobias Herr, Stuttgart (DE)

(73) Assignee: ROBERT BOSCH GMBH, Stuttgart (DE)

( * ) Notice: Subject to any disclaimer, the term of this patent is extended or adjusted under 35 U.S.C. 154(b) by 445 days.

(21) Appl. No.: 12/801,822

(22) Filed: Jun. 28, 2010

(65) Prior Publication Data

US 2010/0326687 A1 Dec. 30, 2010

(30) Foreign Application Priority Data

Jun. 26, 2009 (DE) ..... 10 2009 027 223

(51) Int. Cl.
*E02D 7/02* (2006.01)
*B25D 16/00* (2006.01)
*B25D 11/10* (2006.01)

(52) U.S. Cl.
CPC ..... *B25D 16/006* (2013.01); *B25D 11/102* (2013.01); *B25D 2211/064* (2013.01); *B25D 2216/0023* (2013.01); *B25D 2216/0038* (2013.01)

(58) Field of Classification Search
CPC ..... B25D 2217/0088; B25D 16/006; B25D 2250/245; B25D 16/003; B25D 2216/0069; B25D 2216/0084; B25D 21/02; B25D 21/026; B25D 21/00; B25D 13/463; B25D 23/1405; B25D 23/1475
USPC ..... 173/29, 47–48
See application file for complete search history.

(56) References Cited

U.S. PATENT DOCUMENTS 3,545,776 A * 12/1970 Haviland ..... B23B 31/123 279/63
3,619,081 A * 11/1971 Gruska ..... A47J 43/105 416/132 R
3,734,515 A * 5/1973 Dudek ..... 279/144
3,807,815 A * 4/1974 Kasabian ..... 384/517
4,050,569 A * 9/1977 Crump ..... B41J 19/94 400/314
4,064,949 A * 12/1977 Chromy ..... 173/14
4,131,165 A * 12/1978 Wanner et al. ..... 173/48
4,204,580 A * 5/1980 Nalley ..... 173/48
4,223,744 A * 9/1980 Lovingood ..... 173/48
4,229,981 A * 10/1980 Macky ..... B25D 16/003 173/48
4,489,792 A * 12/1984 Fahim ..... B25D 11/106 173/29

(Continued)

FOREIGN PATENT DOCUMENTS

CA 2540096 A1 9/2007
CN 1748950 3/2006

(Continued)

*Primary Examiner* — Robert Long
(74) *Attorney, Agent, or Firm* — Norton Rose Fulbright US LLP; Gerard Messina

(57) ABSTRACT

A hand-guided power tool, having a housing and a tool holder disposed on a drive shaft. The drive shaft is rotatably supported in the housing in at least one first bearing that is disposed in at least some portions in the vicinity of a face end of the housing oriented toward the tool holder. Between the first bearing and the tool holder, a detent mechanism for impact generation for the drive shaft is embodied.

25 Claims, 2 Drawing Sheets

(56) References Cited

U.S. PATENT DOCUMENTS 4,526,497 A * 7/1985 Hatfield ..... B23B 31/1238 279/134
4,536,113 A * 8/1985 Hatfield ..... B23B 31/1238 279/125
4,627,628 A * 12/1986 Rohm ..... B23B 31/123 279/140
4,683,961 A * 8/1987 Schoeps ..... B25B 21/02 173/93
4,824,298 A * 4/1989 Lippacher et al. ..... 408/240
5,199,833 A * 4/1993 Fehrle et al. ..... 408/239 R
5,457,866 A * 10/1995 Noda ..... B25B 21/026 173/183
5,458,206 A * 10/1995 Bourner ..... B25B 23/14 173/104
5,628,374 A * 5/1997 Dibbern, Jr. ..... 173/48
5,992,538 A * 11/1999 Marcengill et al. ..... 173/93
RE36,558 E * 2/2000 Moore et al. ..... 279/147
6,045,141 A * 4/2000 Miles ..... B23B 31/1238 279/60
6,053,507 A * 4/2000 Yang ..... 279/62
6,073,939 A * 6/2000 Steadings ..... B23B 31/123 279/140
6,079,716 A * 6/2000 Harman et al. ..... 279/75
6,142,242 A * 11/2000 Okumura ..... B25B 23/141 173/216
6,152,242 A * 11/2000 Chung ..... B25D 16/00 173/216
6,479,911 B1 * 11/2002 Koike ..... H02K 1/145 310/257
6,533,291 B2 * 3/2003 Huggins et al. ..... 279/29
6,536,782 B2 * 3/2003 Rohm ..... 279/62
6,550,785 B2 * 4/2003 Rohm ..... 279/62
6,687,567 B2 2/2004 Watanabe
6,688,610 B2 * 2/2004 Huggins et al. ..... 279/22
7,063,201 B2 * 6/2006 Nakamura ..... B25F 5/001 173/217
7,070,008 B2 * 7/2006 Baumann et al. ..... 173/48
7,225,884 B2 * 6/2007 Aeberhard ..... 173/93.5
7,296,803 B2 * 11/2007 Yang et al. ..... 279/62
7,331,584 B2 * 2/2008 Zhang ..... B23B 31/1238 279/60
7,481,608 B2 * 1/2009 Zhou et al. ..... 408/240
7,491,020 B2 * 2/2009 Gehret ..... B23B 31/1238 279/134
7,645,101 B2 * 1/2010 Puzio ..... 408/124
7,690,658 B2 * 4/2010 Puzio ..... B23B 31/1253 279/134
7,753,381 B2 * 7/2010 Nickels, Jr. ..... B23B 31/123 279/125
7,798,245 B2 * 9/2010 Trautner ..... B23B 45/008 173/117
7,874,378 B2 * 1/2011 Chen ..... 173/29
7,997,837 B2 * 8/2011 Furusawa et al. ..... 408/239 R
8,104,546 B2 * 1/2012 Aeberhard ..... 173/178
8,464,805 B2 * 6/2013 Baumann et al. ..... 173/109
2001/0035292 A1 * 11/2001 Bieber et al. ..... 173/178
2004/0149470 A1 * 8/2004 Chan ..... B25B 21/026 173/178
2004/0245005 A1 * 12/2004 Toyama et al. ..... 173/48
2006/0006614 A1 * 1/2006 Buchholz et al. ..... 279/19
2006/0185870 A1 * 8/2006 Gehret et al. ..... 173/217
2006/0232022 A1 * 10/2006 Nickels, Jr. ..... B23B 31/1238 279/60
2006/0244224 A1 * 11/2006 Zhou et al. ..... 279/62
2007/0149293 A1 * 6/2007 Veit et al. ..... 464/39
2007/0158086 A1 * 7/2007 Puzio ..... 173/48
2009/0066039 A1 * 3/2009 Cachod ..... 279/60
2010/0024139 A1 * 2/2010 Linsbichler et al. ..... 15/31
2010/0044063 A1 * 2/2010 Chen ..... 173/93.5
2010/0193207 A1 * 8/2010 Mok et al. ..... 173/48
2010/0270045 A1 * 10/2010 Ullrich ..... B25D 16/006 173/47
2011/0005355 A1 * 1/2011 Brennenstuhl et al. ..... 81/57.38
2011/0127059 A1 * 6/2011 Limberg et al. ..... 173/216
2011/0147024 A1 * 6/2011 Herr ..... 173/48
2011/0147029 A1 * 6/2011 Roehm et al. ..... 173/176
2012/0111594 A1 * 5/2012 Herr ..... 173/104
2012/0292865 A1 * 11/2012 Sugimoto et al. ..... 279/142
2013/0220658 A1 * 8/2013 Ontl et al. ..... 173/211

FOREIGN PATENT DOCUMENTS

CN 1891408 1/2007
CN 1325225 C 6/2007
CN 201220406 4/2009
DE 2557118 6/1977
DE 4419825 12/1995
EP 1375076 A1 * 1/2004 ..... B25D 16/00
GB 1580308 A 12/1980
WO 2008017151 A1 2/2008
WO WO 2008017151 A2 * 2/2008 ..... 45/46

* cited by examiner

HANDHELD POWER TOOL

CROSS-REFERENCE TO RELATED APPLICATION

This application is based on German Patent Application 10 2009 027 223.2 filed Jun. 26, 2009.

BACKGROUND OF THE INVENTION

Field of the Invention

The present invention relates to a hand-guided power tool, having a housing and a tool holder that is disposed on a drive shaft which is rotatably supported in the housing in at least one first bearing that is disposed in at least some portions in the vicinity of a face end of the housing oriented toward the tool holder.

Description of the Prior Art

From the prior art, hand-guided power tools of this kind are known. They may have a detent mechanism for impact generation for the drive shaft, which detent mechanism can be switched on during operation of the power tool. As a rule, the detent mechanism includes one detent disk structurally connected to the housing and one detent disk structurally connected to the drive shaft, which are disposed between the first bearing of the drive shaft and a second bearing that is disposed in the vicinity of a gear mechanism that drives the shaft, or between that second bearing and the gear mechanism. For impact generation during operation of the power tool, the detent disks are put into operative engagement with one another.

It is disadvantageous in the prior art that this power tool requires not inconsiderable installation space and in particular has a not inconsiderable structural length.

OBJECT AND SUMMARY OF THE INVENTION

One object of the invention is therefore to furnish a novel hand-guided power tool, having a detent mechanism, in which reducing an associated installation space is made possible.

This problem is attained by a hand-guided power tool, having a housing and a tool holder that is disposed on a drive shaft which is rotatably supported in the housing in at least one first bearing that is disposed in at least some portions in the vicinity of a face end of the housing oriented toward the tool holder. A detent mechanism for impact generation for the drive shaft is embodied between the first bearing and the tool holder.

The invention thus makes it possible to furnish a hand-guided power tool in which, by means of a disposition of the detent mechanism between a bearing of the drive shaft toward the tool holder and the tool holder itself, a reduction in an installation space required for the power tool and a reduction in an associated took weight are made possible.

In one embodiment, the tool holder has a drill chuck, provided with clamping bodies and a clamping bush, which drill chuck is secured to a securing device provided on the drive shaft.

Thus a safe and reliable tool holder can be furnished.

The detent mechanism has at least one first detent disk secured to the drive shaft. The first detent disk is preferably disposed in at least some portions radially inside the clamping bodies and/or the clamping bush.

The invention thus makes it possible to reduce the structural length of the power tool.

In one embodiment, the first detent disk is integrally formed onto the drive shaft.

Thus a stable, economical drive shaft and detent disk arrangement can be furnished.

The detent mechanism has at least one second detent disk, secured to the housing, which detent disk in an impact mode of operation of the power tool is in operative engagement with the first detent disk for impact generation for the drive shaft. The second detent disk is connected to a ringlike element, in which the first bearing is supported.

The invention thus makes it possible to furnish a simple, compact power tool.

In one embodiment, the drive shaft is drivable via a gear mechanism. The drive shaft is rotatably supported in at least one second bearing which is disposed in at least some portions in the vicinity of a face end of the gear mechanism that is oriented toward the face end of the housing.

Thus a stable and safe support of the drive shaft can be made possible.

The second detent disk preferably has a support element for axially bracing the first bearing.

Thus an axial displacement of the first bearing in operation of the power tool can be restricted in a simple way.

In one embodiment, a sealing element is provided for sealing off the detent mechanism.

The invention thus makes it possible in a simple way to protect the detent disks of the detent mechanism from dust, dirt, and loss of grease.

BRIEF DESCRIPTION OF THE DRAWINGS

The invention will be better understood and further objects and advantages thereof will become more apparent from the ensuing detailed description of preferred embodiments taken in conjunction with the drawings, in which.

DESCRIPTION OF THE PREFERRED EMBODIMENTS

Figure 1:
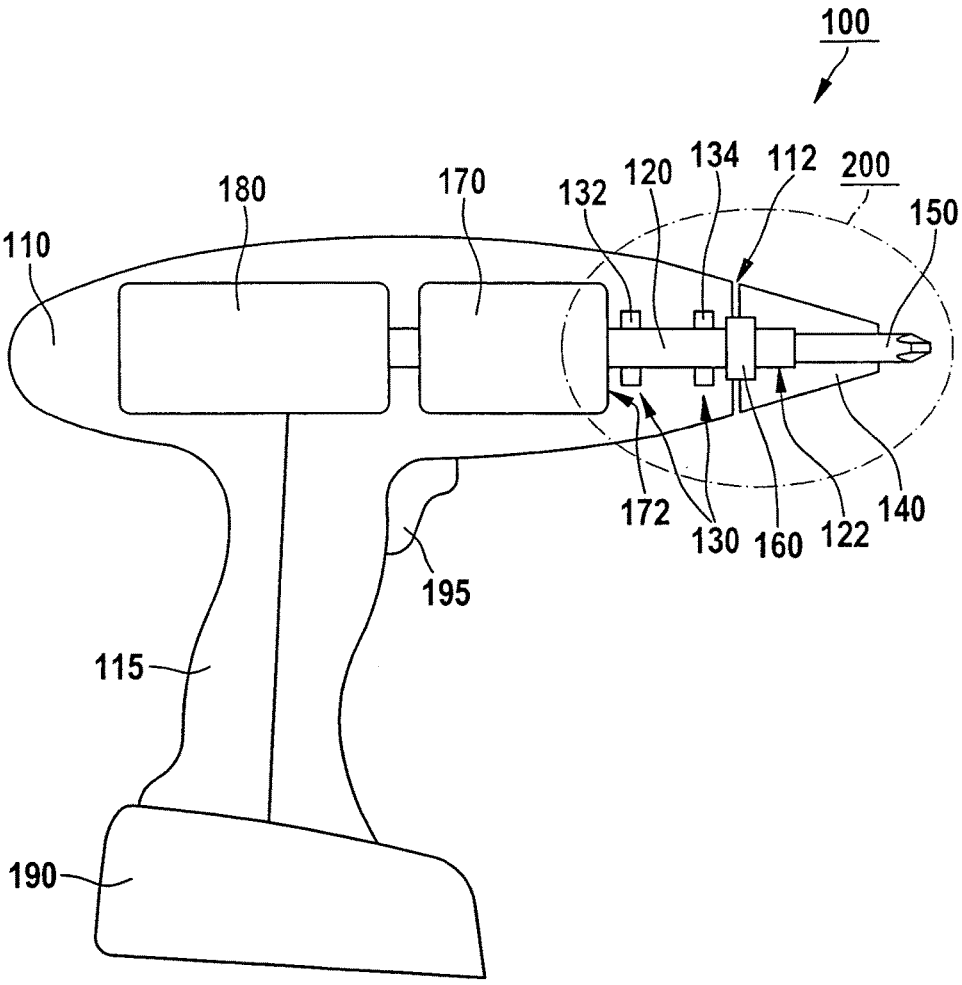
FIG. 1 is a schematic view of a hand-guided power tool in a first embodiment.

FIG. 1 shows a hand-guided power tool 100, which has a housing 110 with a handle 115. In one embodiment, the power tool 100 can be connected mechanically and electrically to a rechargeable battery pack 190 so that it can be supplied with power in cordless fashion. In FIG. 1, the power tool 100 is embodied as a cordless drill screwdriver, for example. However, it will be noted that the present invention is not limited to cordless drill screwdrivers but on the contrary can be employed in various power tools, particularly those operated with rechargeable batteries, such as a cordless screwdriver, a cordless power impact drill, and so forth.

An electric drive motor 180, supplied with power by the battery pack 190, and a gear mechanism 170 are disposed in the housing 110. The drive motor 180 is shown as being actuatable or in other words capable of being switched on and off via a manual switch 195 as an example, and it can be any arbitrary type of motor, such as an electronically commutated motor or a direct current motor. Preferably, the drive motor 180 can be controlled and regulated electronically in such a way that both operation in reverse and specifications indicating a desired rotary speed can be attained. The mode of operation and construction of a suitable drive motor are well known in the prior art, and so to keep the description concise, a detailed description of it is dispensed with.

The drive motor 180 is connected via the gear mechanism 170 to a drive shaft 120. This shaft is supported rotatably in the housing 110 via a bearing arrangement 130 and is provided with a tool holder 140 that is disposed in the vicinity of one face end 112 of the housing 110. The bearing arrangement 130 may be secured to the housing 110, for instance via associated securing elements, or it may be disposed in an associated intermediate element, such as a separate gear housing in which the gear mechanism 170 is disposed, or a separate motor housing, in which the motor 180 and the gear mechanism 170 are disposed; the gear housing and the motor housing are disposed in the housing 110. The tool holder 140 serves to receive a tool bit 150 and may be an integral component of the drive shaft 120, or it may be connected to it in the form an attachment. In FIG. 1, the tool holder 140 is embodied as an attachment for example and is secured to the drive shaft 120 via a securing device 122 provided on the drive shaft.

The bearing arrangement 130, in one embodiment, has a first bearing 134 and a second bearing 132 spaced apart from the first. The first bearing 134 is disposed as an example at least in some portions in the vicinity of the face end 112 of the housing 110 and will therefore hereinafter also be called the "bearing 134 on the tool holder end". The second bearing 132 is disposed for instance at least in some portions in the vicinity of a face end 172 of the gear mechanism 170 that faces toward the face end 112 of the housing 110 and will therefore hereinafter also be called the "bearing 132 on the gear end".

In one embodiment, a detent mechanism 160 is embodied between the bearing 134 on the tool holder end and the tool holder 140 itself. This detent mechanism, in operation of the power tool 100, makes it possible to attain an impact mode of operation, in which a percussive motion of the drive shaft 120 is generated. The detent mechanism 160 will be described in detail hereinafter in conjunction with a sectional view, shown enlarged in FIG. 2, of a detail 200.

Figure 2:
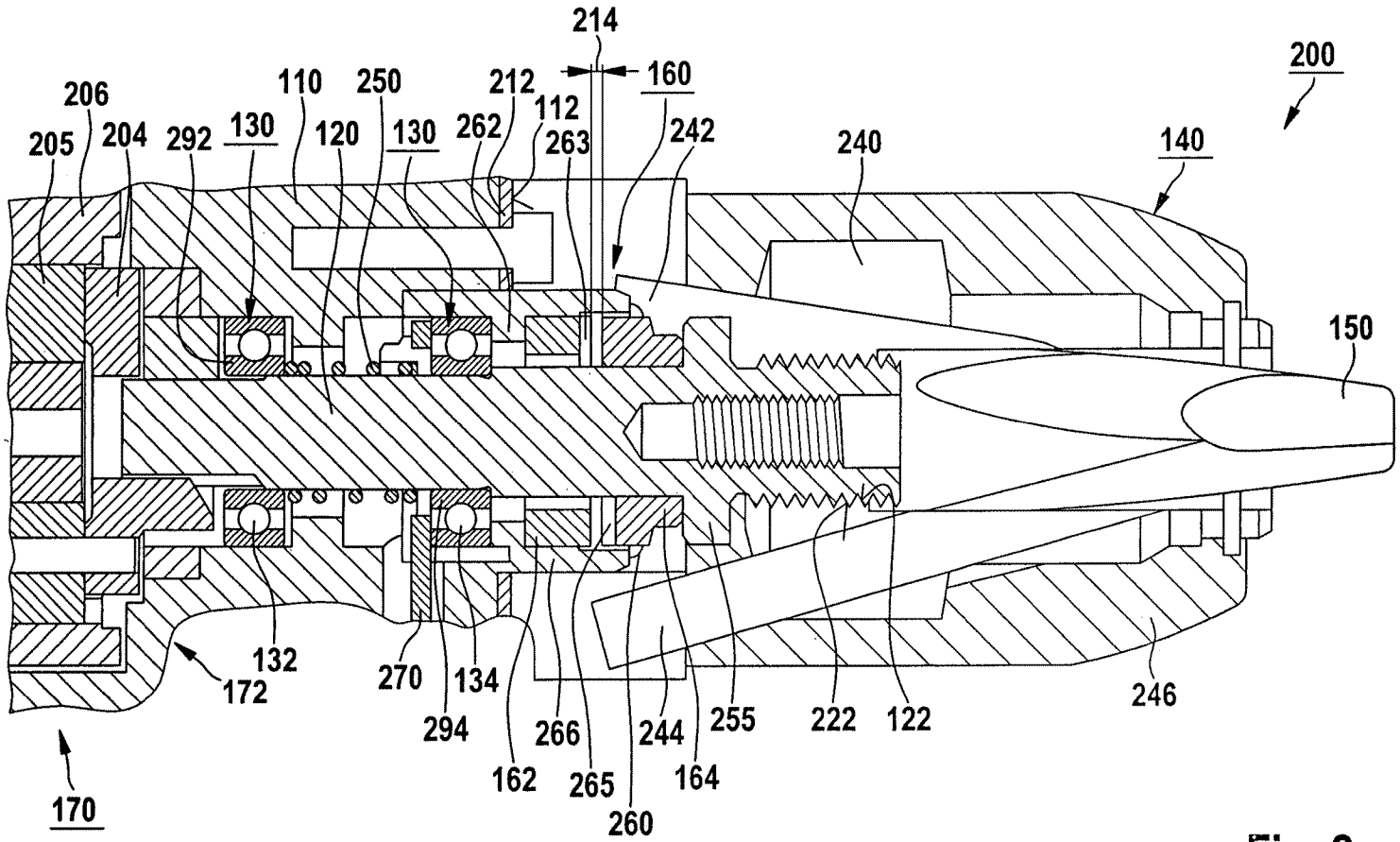
FIG. 2 is an enlarged sectional view of a detail of the power tool of FIG. 1.

FIG. 2 shows the detail 200 of the hand-guided power tool 100 of FIG. 1 in the normal mode of operation, that is, in the drilling or screwdriving mode without impact generation, or upon idling of the power tool 100. The detail 200 clearly illustrates an example of a design of the tool bit 150 and the tool holder 140, of the gear mechanism 170, of the bearing arrangement 130, and of the drive shaft 120, as well as of the detent mechanism 160 for impact generation for the drive shaft 120 in the impact mode of operation of the power tool 100.

The tool holder 140 has as an example a drill chuck 240, which is secured to the securing device 122 of the drive shaft 120. The securing device 122 is embodied for example as a male thread, which is in threaded engagement with a female thread 222 provided on the drill chuck 240. The drill chuck 240 furthermore has a predetermined number of clamping bodies 242, 244, for instance three or four of them, for fastening the tool bit 150, as well as a clamping bush 246, which essentially sheathes the drill chuck 240. The tool bit 150 is rotated in operation of the power tool 100 by means of a rotation of the drive shaft 120.

The gear mechanism 170, in one embodiment, is a planetary gear embodied with various gear or planet stages, which in operation of the power tool 100 is driven to rotate by the drive motor 180. The planetary gear mechanism 170 has for example one hollow wheel 206, at least one planet wheel 205, and a driver 204, and it transmits the torque of the drive motor 180, via the planet stages, to the drive shaft 120 by means of a rotation slaving contour of the driver 204.

As can be seen from FIG. 2, the bearings 132, 134 of the bearing arrangement 130 that are provided for supporting the drive shaft 120 are preferably embodied as ball bearings. The drive shaft 120 is embodied for example as a drive spindle, with a bracing flange 255, so that in the present exemplary embodiment, the bearings 132, 134 act as spindle bearings. However, it should be noted that still other types of bearings can be used within the scope of the present invention. For instance, the bearings 132, 134 may alternatively be in the form of slide bearings, a needle bush, roller bearings, or antifriction bearings.

The bearing 132 on the gear end is disposed axially and radially immovably in the housing 110. The bearing 134 on the tool holder end is disposed axially immovably on the drive shaft 120, for instance with a press fit. As an alternative, the bearing 134 may be integrally formed onto the drive shaft 120 and thus be embodied in one piece with it. In one embodiment, the bearing 134 is urged in the direction of the drill chuck 240 by a spring element 250, such as a compression spring, disposed between this bearing and the bearing 132 on the gear end. The spring element 250 rests with its axial end regions preferably against inner rings 292, 294 of the bearings 132 and 134, respectively.

The detent mechanism 160 is shown as an example disposed between the bearing 134 on the tool holder end and the drill chuck 240, and as an example it has at least one first detent disk 164 secured to the drive shaft 120 and at least one second detent disk 162 secured to the housing 110. In the impact generation of the power tool 100, the detent disks 162, 164, for impact generation for the drive shaft 120, are in operative engagement with one another via a face-end set of teeth 263 provided on the detent disk 162 and a face-end set of teeth 265 provided on the detent disk 164. In the normal mode of operation and in the idling mode, the sets of teeth 263, 265 are spaced apart and separated from one another, respectively.

The first detent disk 164 is secured axially and radially immovably on the drive shaft 120, for instance by a press fit, and are braced as an example on the bracing flange 255. As an alternative to this, the detent disk 164 may be integrally formed onto the drive shaft 120 and thus embodied in one piece with it. In one embodiment, the first detent disk 164 is oriented toward the drill chuck 240 and will therefore hereinafter also be called the "detent disk 164 on the drill chuck end". It is preferably disposed in at least some portions radially inside the clamping bodies 242, 244 and/or the clamping bush 246.

The second detent disk 162 is connected to a ringlike element 266, which is secured axially and radially immovably on the housing 110, or in the vicinity of its face end 112, and the detent disk 162 may be secured to the ringlike element 266 or integrally formed or embodied in one piece with it. The second detent disk 162 will therefore hereinafter also be called the "detent disk 162 on the gear end". Like the detent disk 164 on the drill chuck end, it is preferably disposed outside the housing 110. The face end 112 of the housing 110 is formed as an example by a sheet-metal-like fixation member 212, which serves to fix the ringlike element 266 in or on the housing 110.

In one embodiment, the bearing 134 on the tool holder end is supported axially displaceably but radially immovably in the ringlike element 266 or in the detent disk 162 on the gear end. To limit an axial displacement of the bearing 134 in the direction of the drill chuck 240, the detent disk 162 on the gear end has a support element 262 for axially bracing the bearing 134. An axial displacement of the bearing 134 in the direction of the gear mechanism 170 can be blocked by a blocking member 270. It is preferably connected to an adjusting device, which for the sake of clarity and simplicity is not shown and with which the normal mode of operation or the impact mode of operation of the power tool 100 can in particular be selectively adjusted.

For sealing off the detent mechanism 160, a sealing element 260 is provided, in order to protect the detent mechanism against dirt and dust and loss of its grease and thus to prevent impairment of its functionality. The sealing element 260 may be embodied as an example as a bellows, so that its air budget is unaffected upon an axial displacement of the detent disk 164 on the drill chuck end. An O-ring, radial shaft seal ring, or gap seal, that is, a seal embodied by an air gap with axial expansion, provided between the detent disks 162, 164, can equally well be employed, so that venting is made possible between the drive shaft 120 and the detent disk 162 on the gear end and between the bearing 134 on the tool holder end and the detent disk 162 on the gear end.

In the normal mode of operation and in idling of the power tool 100, the bearing 134 on the tool holder end is pressed against the support element 262 in the axial direction and blocked by the blocking member 270. Thus the drive shaft 120 cannot be displaced in the direction of the planetary gear mechanism 170, so that the detent disks 162, 164 are spaced apart from one another by a predetermined distance 214, and hence their face-end sets of teeth 263, 265 cannot be brought into operative engagement with one another.

In the impact mode of operation of the power tool 100, an axial displacement of the drive shaft 120 is enabled by release of the blocking member 270. Now, by means of a contact pressure exerted by a user on the power tool 100 or its housing 110, an axial displacement of the housing 110 relative to the tool holder 140 counter to the force of the spring element 250 can be attained, such that the face-end sets of teeth 263, 265 of the respective detent disks 162 and 164 mesh with one another, and as a result of this operative engagement, impact generation for the drive shaft 120 is made possible. This kind of impact generation is well known in the prior art, so that to keep the description concise, a detailed description of it will be dispensed with.

Since as described above the spring element 250 urges the bearing 134 on the tool holder end in the direction of the drill chuck 240, this makes it possible to switch the power tool 100 back and forth between the normal mode of operation and idling. To that end, the bearing 134 on the tool holder end, as described above, is blocked by means of the blocking member 270 in an axial position associated with the normal mode of operation or idling as applicable.

The foregoing relates to preferred exemplary embodiments of the invention, it being understood that other variants and embodiments thereof are possible within the spirit and scope of the invention, the latter being defined by the appended claims.

We claim:

1. A hand-guided power tool, comprising:

a housing;

a drive shaft which is rotatably supported in said housing;

a tool holder disposed on said drive shaft;

at least one first bearing which is rotatably supporting said drive shaft;

at least one second bearing which is rotatably supporting said drive shaft; and a detent mechanism for impact generation for the drive shaft embodied between the first bearing and the tool holder, wherein the detent mechanism has at least one first detent disk integrally formed onto or secured to the drive shaft and at least one second detent disk, which second detent disk has a face-end set of teeth which in an impact mode of operation of the power tool is in operative engagement with a face-end set of teeth of the first detent disk for impact generation for the drive shaft, wherein the detent mechanism is arranged closer to the tool holder than both the first bearing and the second bearing, wherein the tool holder is embodied as a drill chuck, provided with clamping bodies and a clamping bush, said drill chuck is secured to the drive shaft.

2. The hand-guided power tool as defined by claim 1, wherein the first detent disk is disposed in at least some portions radially inside the clamping bodies and/or the clamping bush.

3. The hand-guided power tool as defined by claim 1, wherein the first detent disk is integrally formed onto the drive shaft.

4. The hand-guided power tool as defined by claim 1, wherein the first detent disk is secured to the drive shaft.

5. The hand-guided power tool as defined by claim 2, wherein the first detent disk is secured to the drive shaft.

6. The hand-guided power tool as defined by claim 1, wherein the second detent disk is connected to a ring-shaped element, in which the first bearing is supported.

7. The hand-guided power tool as defined by claim 1, wherein the drive shaft is drivable via a gear mechanism, and the at least one second bearing is disposed in at least some portions in a vicinity of a face end of the gear mechanism that is oriented toward the face end of the housing.

8. The hand-guided power tool as defined by claim 1, wherein the second detent disk has a support element for axially bracing the first bearing.

9. The hand-guided power tool as defined by claim 1, wherein a sealing element is provided for sealing off the detent mechanism.

10. The hand-guided power tool as defined by claim 1, wherein the first bearing is disposed axially immovably on the drive shaft.

11. The hand-guided power tool as defined by claim 1, wherein the first bearing is urged in a direction of the tool holder by a spring element.

12. The hand-guided power tool as defined by claim 6, wherein the first bearing is supported axially displaceably and radially immovably in the ring-shaped element.

13. The hand-guided power tool as defined by claim 1, wherein the second bearing is disposed adjacent to a face end of a gear mechanism, said face end of the gear mechanism being oriented toward the tool-holder along a rotational axis of the drive shaft.

14. The hand-guided power tool as defined by claim 1, wherein the second bearing is disposed axially immovably relative to the housing.

15. The hand-guided power tool as defined by claim 1, wherein the second detent disk is connected to a ring-shaped element, in which the first bearing is supported, the ring-shaped element secured axially and radially immovably to the housing.

16. A hand-guided power tool, comprising:

a housing;

a drive shaft which is rotatably supported in said housing;

a tool holder disposed on said drive shaft;

at least one first bearing which is rotatably supporting said drive shaft; and a detent mechanism for impact generation for the drive shaft, wherein the detent mechanism has at least one first detent disk disposed on the drive shaft and at least one second detent disk, which second detent disk in an impact mode of operation of the power tool is in operative engagement with the first detent disk for impact generation for the drive shaft, wherein the second detent disk is connected to a ring-shaped element, in which the first bearing is supported, the ring-shaped element secured axially and radially immovably to the housing.

17. A hand-guided power tool, comprising:

a housing;

a drive shaft which is rotatably supported in said housing;

a tool holder disposed on said drive shaft, the tool holder being embodied as a drill chuck which comprises clamping bodies and a clamping bush;

at least one first bearing which is rotatably supporting said drive shaft; and a detent mechanism for impact generation for the drive shaft, wherein the detent mechanism has at least one first detent disk disposed on the drive shaft, wherein the first detent disk is in at least some portions radially encompassed by the clamping bodies and/or the clamping bush of the drill chuck, wherein the detent mechanism has at least one second detent disk, which second detent disk in an impact mode of operation of the power tool is in operative engagement with the first detent disk for impact generation for the drive shaft.

18. The hand-guided power tool as defined by claim 17, wherein the first detent disk is integrally formed onto the drive shaft.

19. The hand-guided power tool as defined by claim 17, wherein the first detent disk is secured to the drive shaft.

20. The hand-guided power tool as defined by claim 1, wherein the second detent disk is secured to the housing.

21. The hand-guided power tool as defined by claim 1, wherein the second detent disk is secured to a ring-shaped element which is fixedly connected to the housing.

22. The hand-guided power tool as defined by claim 21, wherein the ring-shaped element has a support element configured to axially support the first bearing.

23. The hand-guided power tool as defined by claim 1, wherein the first bearing is disposed axially fixedly on the drive shaft.

24. The hand-guided power tool as defined by claim 1, wherein the clamping bodies and/or the clamping bush are arranged to radially encompass at least a portion of the first detent disk.

25. The hand-guided power tool as defined by claim 1, wherein the second bearing is disposed toward an axial end of the drive shaft, the axial end being opposite to the tool holder along a rotational axis of the drive shaft.

* * * * *